US008457345B2

(12) United States Patent
Matsuo

(10) Patent No.: US 8,457,345 B2
(45) Date of Patent: Jun. 4, 2013

(54) VIBRATION PLATE, SPEAKER UNIT AND PORTABLE INFORMATION TERMINAL

(75) Inventor: Yuji Matsuo, Daito (JP)

(73) Assignee: Sanyo Electric Co., Ltd., Moriguchi-shi, Osaka (JP)

( * ) Notice: Subject to any disclaimer, the term of this patent is extended or adjusted under 35 U.S.C. 154(b) by 92 days.

(21) Appl. No.: 13/240,527

(22) Filed: Sep. 22, 2011

(65) Prior Publication Data

US 2012/0082327 A1 Apr. 5, 2012

(30) Foreign Application Priority Data

Sep. 30, 2010 (JP) ..... 2010-221443

(51) Int. Cl.
*H04R 1/00* (2006.01)
*H04R 9/06* (2006.01)
*H04R 11/02* (2006.01)

(52) U.S. Cl.
USPC ..... 381/423; 381/430; 381/396

(58) Field of Classification Search
USPC ..... 381/184, 396, 400, 403, 405, 412, 381/417, 423, 430; 181/163–165; 379/431, 379/433.02, 432
See application file for complete search history.

(56) References Cited

U.S. PATENT DOCUMENTS

| | | | | |
|---|---|---|---|---|
| 6,834,114 | B2 * | 12/2004 | Kobayashi et al. | 381/396 |
| 2002/0097890 | A1 * | 7/2002 | Kobayashi et al. | 381/412 |
| 2003/0219140 | A1 * | 11/2003 | Choi | 381/412 |
| 2006/0153420 | A1 * | 7/2006 | Takase et al. | 381/424 |

FOREIGN PATENT DOCUMENTS

JP 2006-229657 A 8/2006

* cited by examiner

*Primary Examiner* — Tuan D Nguyen
(74) *Attorney, Agent, or Firm* — Westerman, Hattori, Daniels & Adrian, LLP

(57) ABSTRACT

An edge portion includes a center portion, one end and an other end. As seen in a cross section of a vibration plate in the radial direction, the center portion, the one end and the other end each are formed in a circular arc such that the edge portion forms a convex so as to protrude in a direction in which the protruding shape protrudes. The radius of curvature of the circular arc of the center portion is not less than the radius of curvature of the circular arc of each of the one end and the other end. Accordingly, a vibration plate allowing a decrease in the lowest resonance frequency while suppressing the edge portion from being brought into a tensioned state, a speaker unit provided with the vibration plate and a portable information terminal can be provided.

6 Claims, 13 Drawing Sheets

VIBRATION PLATE, SPEAKER UNIT AND PORTABLE INFORMATION TERMINAL

This nonprovisional application is based on Japanese Patent Application No. 2010-221443 filed on Sep. 30, 2010, with the Japan Patent Office, the entire contents of which are hereby incorporated by reference.

BACKGROUND OF THE INVENTION

1. Field of the Invention

The present invention relates to a vibration plate, a speaker unit and a portable information terminal, and particularly to a vibration plate having an edge portion, a speaker unit provided with the vibration plate, and a portable information terminal.

2. Description of the Related Art

A speaker unit is mounted in a portable information terminal such as a mobile phone, a digital camera, a personal computer, a game machine, and a PDA (Personal Digital Assistant). The speaker unit includes a vibration plate. In addition, the speaker unit includes the so-called speaker and receiver.

It is required to decrease the lowest resonance frequency in order to improve the performance of the speaker unit. For example, there are the following three methods of decreasing the lowest resonance frequency. The first method is to reduce the thickness of the vibration plate. The second method is to increase the radius of curvature of the edge portion. The third method is to increase the mass of the vibration system which is the total mass of the vibration plate and the voice coil.

Furthermore, for example, Japanese Patent Laying-Open No. 2006-229657 discloses another method of decreasing the lowest resonance frequency by which the center portion and the edge portion of the vibration plate are formed from different members. This patent literature discloses that the center vibration portion and the annular vibration portion (edge portion) of a diaphragm (vibration plate) are formed from different members to enhance the rigidity of the center vibration portion while lowering the rigidity of the annular vibration portion, thereby preventing abnormal vibration from occurring in the center vibration portion, but allowing a margin of vibration limit to be provided in the annular vibration portion for suppressing an increase in the lowest resonance frequency.

In the first method as described above, the vibration plate having a reduced thickness causes a decrease in the strength of the vibration plate. Consequently, distortion may be increased to produce unusual noise. Therefore, there is a limit to reducing the thickness of the vibration plate for maintaining the basic sound quality of the speaker unit. Accordingly, the method of reducing the thickness of the vibration plate cannot allow the lowest resonance frequency to be decreased below a certain level.

The second method as described above requires the speaker unit to be reduced in size, which imposes a limit on the outer diameter of the vibration plate. When the radius of curvature of the vibration plate is increased within the size limitations, the shape of the vibration plate in the radial direction becomes nearly a straight line, which leads to a decrease in the line length of the vibration plate in the radial direction. In the state where the line length of the vibration plate in the radial direction is decreased, when the vibration plate is vibrated up and down, the vibration plate is more likely to be brought into a tensioned state. When the vibration plate is brought into a tensioned state, unusual noise may occur. Accordingly, the radius of curvature of the vibration plate should be limited for maintaining the basic sound quality of the speaker unit. Therefore, the method of increasing the curvature of the edge portion cannot allow the lowest resonance frequency to be decreased below a certain level.

In the third method as described above, the increased mass of the vibration system causes a decrease in the sound pressure. Thus, there is a limit to the weight of the mass of the vibration system for maintaining the performance of the speaker unit. Therefore, the method of increasing the mass of the vibration system cannot allow the lowest resonance frequency to be decreased below a certain level.

In the above-described patent literature, the rigidity of the edge portion is suppressed low, which causes a problem that distortion is increased to produce unusual noise similarly to the case in above-described first method. Therefore, in the above-described patent literature, the lowest resonance frequency cannot be decreased below a certain level.

SUMMARY OF THE INVENTION

The present invention has been made in light of the above-described problems. An object of the present invention is to provide a vibration plate allowing a decrease in the lowest resonance frequency while suppressing the edge portion from being brought into a tensioned state, a speaker unit provided with the vibration plate, and a portable information terminal.

A vibration plate of the present invention includes a voice coil attachment portion; a frame attachment portion; and an edge portion located between the voice coil attachment portion and the frame attachment portion and having a protruding shape protruding in one direction with respect to the voice coil attachment portion and the frame attachment portion. The edge portion includes a center portion, one end located between the center portion and the voice coil attachment portion and an other end located between the center portion and the frame attachment portion. As seen in a cross section of the vibration plate in a radial direction, the center portion, the one end and the other end each are formed in a circular arc such that the edge portion forms a convex so as to protrude in a direction in which the protruding shape protrudes. A radius of curvature of the circular arc of the center portion is not less than the radius of curvature of the circular arc of each of the one end and the other end.

According to the vibration plate of the present invention, as seen in the cross section of the vibration plate in the radial direction, the center portion, the one end and the other end each are formed in a circular arc such that the edge portion forms a convex so as to protrude in a direction in which the protruding shape protrudes. The radius of curvature of the circular arc of the center portion is not less than the radius of curvature of the circular arc of each of the one end and the other end. Accordingly, the lowest resonance frequency can be decreased by increasing the radius of curvature of the circular arc of the center portion. Furthermore, the line length of the edge portion in the radial direction can be increased by decreasing the radius of curvature of the circular arc of each of the one end and the other end. Accordingly, the edge portion can be suppressed from being brought into a tensioned state. Consequently, occurrence of unusual noise resulting from the tensioned state can be suppressed.

As described above, the vibration plate, the speaker unit and the portable information terminal according to the present invention allow a decrease in the lowest resonance frequency.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will be hereinafter described with reference to the accompanying drawings.

First Embodiment

The configuration of the speaker unit according to the first embodiment of the present invention will be first described.

Figure 1:
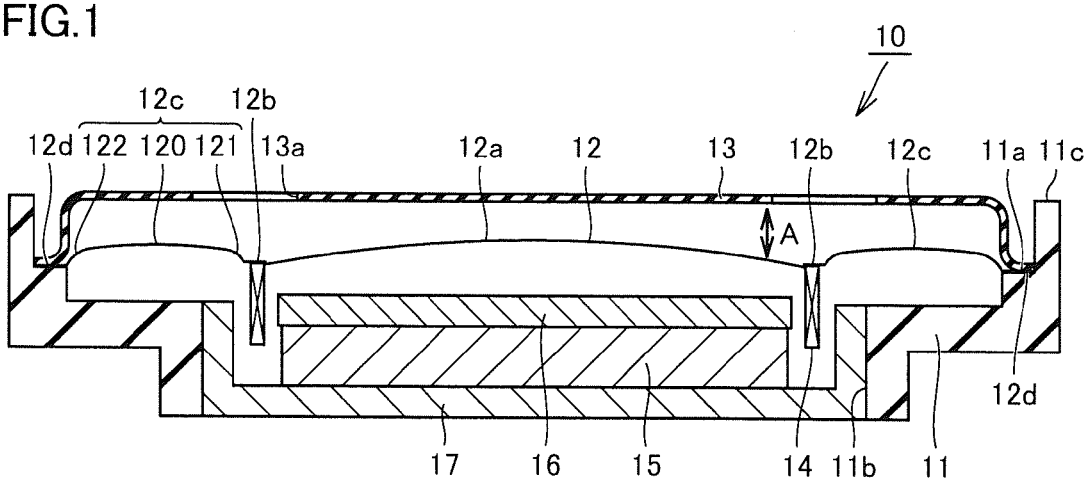
FIG. 1 is a cross sectional view schematically showing a speaker unit in the first embodiment of the present invention.
Figure 2:
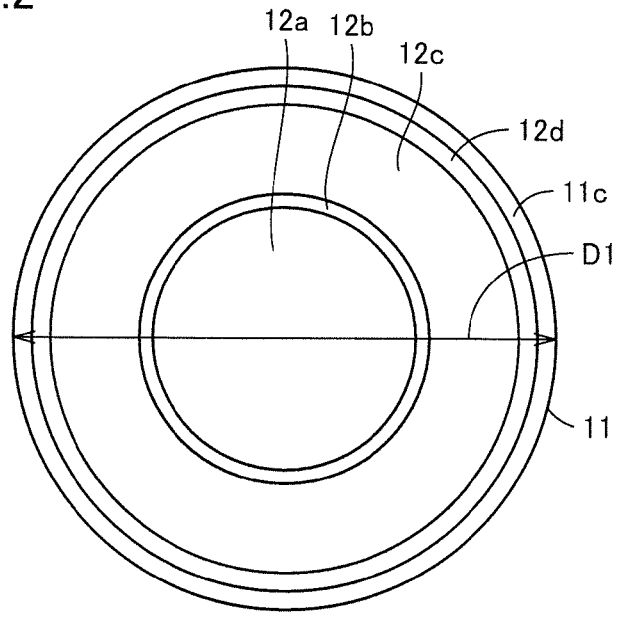
FIG. 2 is a plan view schematically showing the speaker unit in the first embodiment of the present invention.

Referring to FIGS. 1 and 2, a speaker unit 10 mainly includes a frame 11, a vibration plate 12, a frame cover 13, a voice coil 14, a magnet 15, a plate 16, and a yoke 17. It is to be noted that frame cover 13 is not shown in FIG. 2 for the sake of clarity.

Frame 11 mainly has a support portion 11*a*, an inner peripheral portion 11*b* and an upper end 11*c*. Frame 11 is configured such that frame attachment portion 12*d* of vibration plate 12 is supported by the upper surface of support portion 11*a* to thereby allow vibration plate 12 to be vibratably supported. There may be a step provided between support portion 11*a* and inner peripheral portion 11*b*. Furthermore, frame 11 is configured to support yoke 17 at inner peripheral portion 11*b*. Upper end 11*c* is formed continuously on the outer peripheral side of support portion 11*a*. Frame 11 is, for example, formed in a circle shape as seen in the plan view. Frame 11 may be formed, for example, by resin or by metal.

Vibration plate 12 is formed by a thin plate such that it can vibrate in the upward and downward directions (the direction shown by an arrow A in FIG. 1). Vibration plate 12 has a center vibration portion 12*a*, a voice coil attachment portion 12*b*, an edge portion 12*c*, and a frame attachment portion 12*d*. Center vibration portion 12*a* is provided in the center of vibration plate 12. Center vibration portion 12*a* is formed in the shape of a circular arc so as to provide a convex on the upper side of vibration plate 12 in a radial direction D1 as seen in the cross sectional view.

Voice coil attachment portion 12*b* is provided on the outer peripheral side of center vibration portion 12*a*. Voice coil attachment portion 12*b* is provided between center vibration portion 12*a* and edge portion 12*c*. Voice coil attachment portion 12*b* is annularly provided so as to surround center vibration portion 12*a*. Voice coil attachment portion 12*b* serves to attach voice coil 14. Voice coil attachment portion 12*b* is formed in a flat shape as seen in the cross section of vibration plate 12 in radial direction D1. Voice coil attachment portion 12*b* has a step provided in a portion that is contiguous to center vibration portion 12*a*.

Edge portion 12*c* is provided on the outer peripheral side of voice coil attachment portion 12*b*. Edge portion 12*c* which will be described later in detail is configured such that a center portion 120, one end 121 and the other end 122 are continuously provided.

Frame attachment portion 12*d* is provided on the outer peripheral side of edge portion 12*c*. Frame attachment portion 12*d* serves to attach frame 11. Frame attachment portion 12*d* is annularly provided so as to surround edge portion 12*c*. Frame attachment portion 12*d* is formed in a flat shape as seen in the cross section of vibration plate 12 in radial direction D1.

Vibration plate 12 is, for example, formed in a circular shape in the plan view. Vibration plate 12 is formed, for example, by PET (polyethylene terephthalate), PEN (polyethylene naphthalate), PEI (polyether imide), or the like.

Frame cover 13 is formed so as to cover vibration plate 12. Frame cover 13 may be disposed so as to cover a part of each of center vibration portion 12*a* and edge portion 12*c*. Frame cover 13 is supported by support portion 11*a* of frame 11 via vibration plate 12. A hole 13*a* is formed in frame cover 13. Frame cover 13 is, for example, formed in a circular shape as seen in the plan view.

Voice coil 14 is fixed to vibration plate 12 by fixing the upper surface of voice coil 14 to the underside surface of voice coil attachment portion 12*b* of vibration plate 12. Voice coil 14 is formed in an annular shape, for example. Magnet 15 is disposed on the inner peripheral side of voice coil 14 and spaced apart from the inner peripheral surface of voice coil 14 (inner magnet-type). Yoke 17 has a portion disposed on the outer peripheral side of voice coil 14 and spaced apart from the outer peripheral surface of voice coil 14 (outer peripheral portion), and a portion disposed below voice coil 14 and magnet 15 (lower portion).

Yoke 17 is fixed by fitting at the outer peripheral surface of the outer peripheral portion into inner peripheral portion 11*b* of frame 11. The lower portion of yoke 17 is disposed spaced apart from the lower surface of voice coil 14. Magnet 15 is disposed in the center portion of the lower portion of yoke 17. Plate 16 is disposed on the upper surface of magnet 15. These magnet 15, plate 16 and yoke 17 constitute a magnetic circuit.

The configuration of the edge portion of the vibration plate will then be described in detail.

Figure 3:
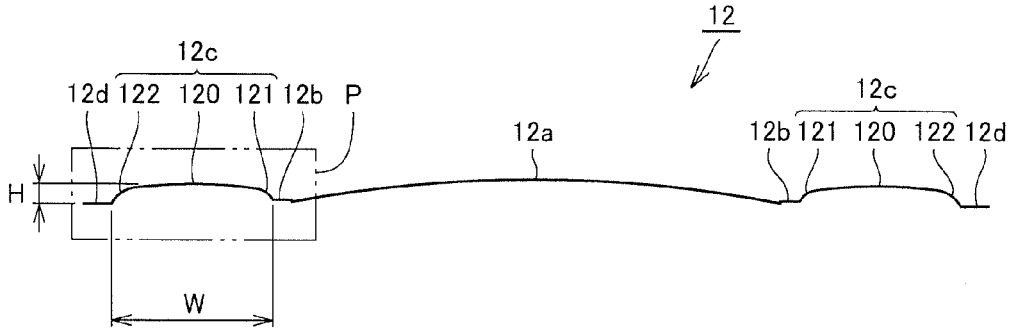
FIG. 3 is a cross sectional view schematically showing a vibration plate in the first embodiment of the present invention.
Figure 4:
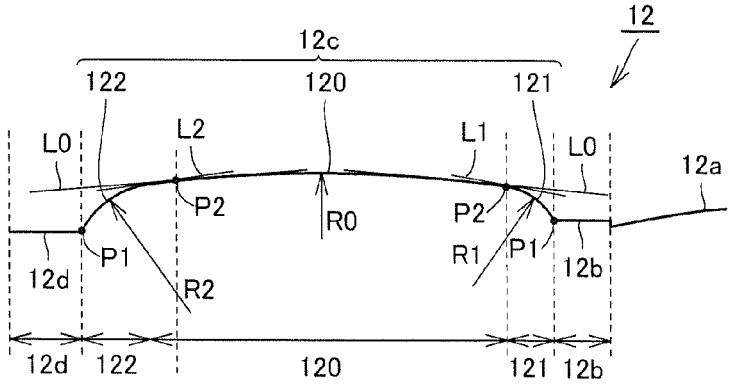
FIG. 4 is an enlarged view showing a P area in FIG. 3.

Referring to FIGS. 3 and 4, edge portion 12*c* has center portion 120, one end 121 and the other end 122. Center portion 120 is provided in the center of edge portion 12*c* as seen in the cross section of vibration plate 12 in radial direction D1 (FIG. 2). Center portion 120 is formed to have a radius of curvature R0.

One end 121 is provided so as to be located between center portion 120 and voice coil attachment portion 12*b*. One end 121 is formed to have a radius of curvature R1. One end 121 is continuously formed so as to connect the outer peripheral edge of voice coil attachment portion 12*b* and the inner peripheral edge of center portion 120. At the position where center portion 120 and one end 121 are in contact with each other, center portion 120 has a tangent line L0 while one end 121 has a tangent line L1.

The other end 122 is provided so as to be located between center portion 120 and frame attachment portion 12*d*. The other end 122 is formed to have a radius of curvature R2. The other end 122 is continuously formed so as to connect the inner peripheral edge of frame attachment portion 12*d* and the outer peripheral edge of center portion 120. At the position where center portion 120 and the other end 122 are in contact with each other, center portion 120 has tangent line L0 while the other end 122 has a tangent line L2.

As seen in the cross section of vibration plate 12 in radial direction D1 (FIG. 2), center portion 120, one end 121 and the other end 122 each are formed in a circular arc such that edge portion 12*c* forms a convex so as to protrude in a direction in which the protruding shape protrudes. Accordingly, tangent line L0, tangent line L1 and tangent line L2 do not extend into the inside of the protruding shape of edge portion 12*c*. In other words, tangent line L0, tangent line L1 and tangent line L2 do not extend into the inside of edge portion 12*c*.

In other words, center portion 120 is formed in a circular arc in which the curvature center of radius of curvature R0 is located on the other side opposite to one side on which edge portion 12*c* forms a convex so as to protrude in a direction in which the protruding shape protrudes with respect to each of voice coil attachment portion 12*b* and frame attachment portion 12*d*. One end 121 is formed in a circular arc in which the curvature center of radius of curvature R1 of one end 121 is located closer to the other end 122 than one end 121. The other end 122 is formed in a circular arc in which the curvature center of radius of curvature R2 of the other end 122 is located closer to one end 121 than the other end 122.

Radius of curvature R1 of the circular arc of one end 121 may be equal to or different from radius of curvature R2 of the circular arc of the other end 122. In the case where radius of curvature R1 of the circular arc of one end 121 is different from radius of curvature R2 of the circular arc of the other end 122, radius of curvature R1 of the circular arc of one end 121 may be greater than radius of curvature R2 of the circular arc of the other end 122, or radius of curvature R2 of the circular arc of the other end 122 may be greater than radius of curvature R1 of the circular arc of one end 121.

Radius of curvature R0 of the circular arc of center portion 120 is equal to or greater than each of radius of curvature R1 of the circular arc of one end 121 and radius of curvature R2 of the circular arc of the other end 122. Accordingly, the inclination of tangent line L0 with respect to radial direction D1 of vibration plate 12 (FIG. 2) is equal to or smaller than the inclination of each of tangent line L1 and tangent line L2. Furthermore, radius of curvature R0 of center portion 120 may be greater than each of radius of curvature R1 of one end 121 and radius of curvature R2 of the other end 122. Also in this case, tangent line L0, tangent line L1 and tangent line L2 do not extend into the inside of the protruding shape of edge portion 12*c*. Furthermore, the inclination of tangent line L0 with respect to radial direction D1 of vibration plate 12 (FIG. 2) is smaller than the inclination of each of tangent line L1 and tangent line L2.

Furthermore, radius of curvature R1 of center portion 120 may be infinite. In this case, center portion 120 has a cross section shaped in a straight line.

Furthermore, each of radius of curvature R0 of center portion 120, radius of curvature R1 of one end 121 and radius of curvature R2 of the other end 122 may be infinite. In this case, center portion 120, one end 121 and the other end 122 each have a cross section shaped in a straight line. The angle formed between center portion 120 and one end 121 and the angle formed between center portion 120 and the other end 122 each are a right angle.

Then, the operation of the speaker unit of the present embodiment will be described.

According to the above-described configuration, the magnetic flux generated from magnet 15 is guided by plate 16 and yoke 17, and converged into a void having voice coil 14 disposed therein, thereby generating a magnetic field. Then, when an alternating current flows into voice coil 14, the alternating current flowing through voice coil 14 and the magnetic field generated from magnet 15 cause voice coil 14 to vibrate up and down based on Fleming's left-hand rule. This causes vibration of vibration plate 12 attached to voice coil 14. Accordingly, an electrical signal (alternating current) is converted into sound (vibration).

Although the inner magnet-type speaker unit has been described in the above, the present embodiment may also be applied to an outer magnet-type speaker unit. An example of the configuration of the outer magnet-type speaker unit will be hereinafter described as the first modification of the present embodiment. Unless specifically mentioned, this configuration is the same as that of the inner magnet-type speaker unit described above, and therefore, the same components will be designated by the same reference characters, and description thereof will not be repeated.

Figure 5:
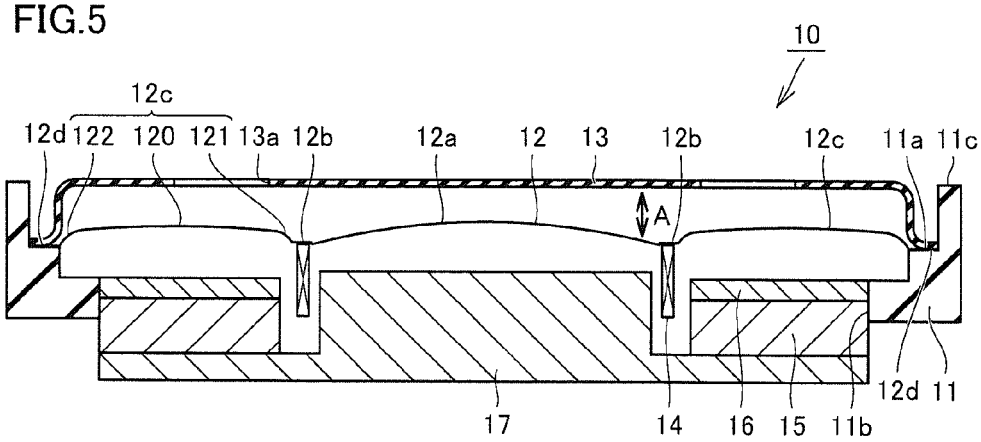
FIG. 5 is a cross sectional view schematically showing a speaker unit of the first modification in the first embodiment of the present invention.

Referring to FIG. 5, in the first modification of the present embodiment, magnet 15 is disposed on the outer peripheral side of voice coil 14 and spaced apart from the outer peripheral surface of voice coil 14 (outer magnet-type). Yoke 17 has a portion disposed on the inner peripheral side of voice coil 14 and spaced apart from the inner peripheral surface of voice coil 14 (inner peripheral portion), and a portion disposed below voice coil 14 and magnet 15 (lower portion). The lower portion of yoke 17 is disposed spaced apart from the lower surface of voice coil 14. Magnet 15 is placed in the lower portion of yoke 17. Furthermore, plate 16 is disposed on the upper surface of magnet 15.

Furthermore, the present embodiment may also be applied to a horizontal-type speaker unit. An example of the configuration of the horizontal-type speaker unit will be hereinafter described as the second modification of the present embodiment. Unless specifically mentioned, this configuration is the same as that of the inner magnet-type speaker unit described above, and therefore, the same components will be designated by the same reference characters, and description thereof will not be repeated.

Figure 6:
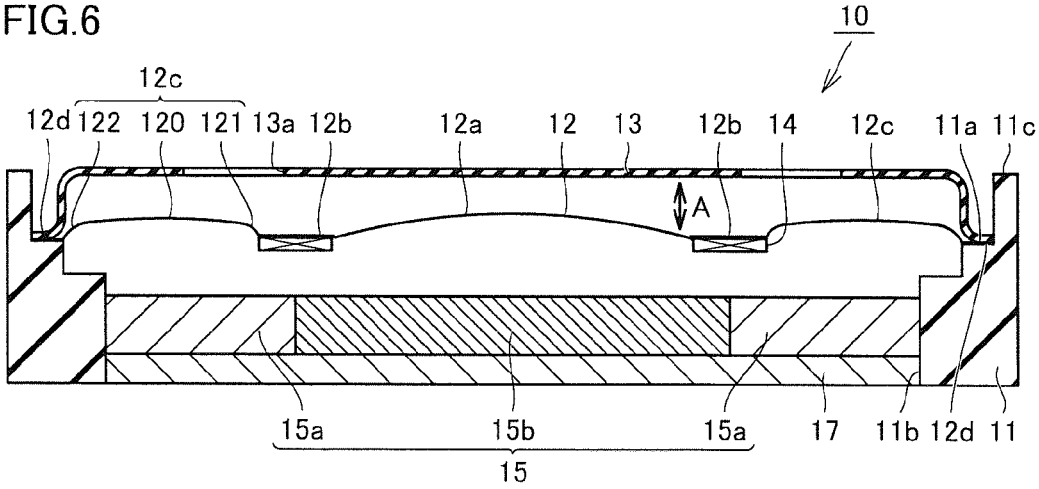
FIG. 6 is a cross sectional view schematically showing a speaker unit of the second modification in the first embodiment of the present invention.

Referring to FIG. 6, in the second modification of the present embodiment, voice coil 14 is formed in such a shape that the number of stacked layers are greater in the width direction than in the thickness direction (horizontal type). Voice coil 14 is disposed above and spaced apart from the upper surface of magnet 15. Voice coil 14 is disposed such that the magnetic flux generated by magnet 15 crosses voice coil 14.

Magnet 15 is magnetized in the thickness direction. Magnet 15 includes a pair of outer magnets 15*a* each having a rectangular parallelepiped shape and an inner magnet 15*b* having a rectangular parallelepiped shape. The pair of outer magnets 15*a* and inner magnet 15*b* are magnetized reversely to each other. In other words, for example, the pair of outer magnets 15*a* each are magnetized to have a lower surface of an N pole while inner magnet 15*b* is magnetized to have an upper surface of an N pole. It is to be noted that the pair of outer magnets 15*a* and inner magnet 15*b* only need to be magnetized reversely to each other.

Magnet 15 is fixed by the outer peripheral surface of outer magnet 15*a* fitting into the inner peripheral surface of frame 11. Yoke 17 is disposed below magnet 15. Yoke 17 is fixed by the side surface of yoke 17 fitting into the inner peripheral surface of frame 11. Frame 11 supports magnet 15 and yoke 17 at the inner peripheral surface.

Although an explanation has been made in the above with regard to the case where the speaker unit is formed in a circular shape as seen in the plan view, the speaker unit may be formed in a stadium shape as seen in the plan view. An example of the configuration of the speaker unit formed in a circular shape as seen in the plan view will be hereinafter described as the third modification of the present embodiment. Unless specifically mentioned, this configuration is the same as that of the inner magnet-type speaker unit described above, and therefore, the same components will be designated by the same reference characters, and description thereof will not be repeated.

Figure 7:
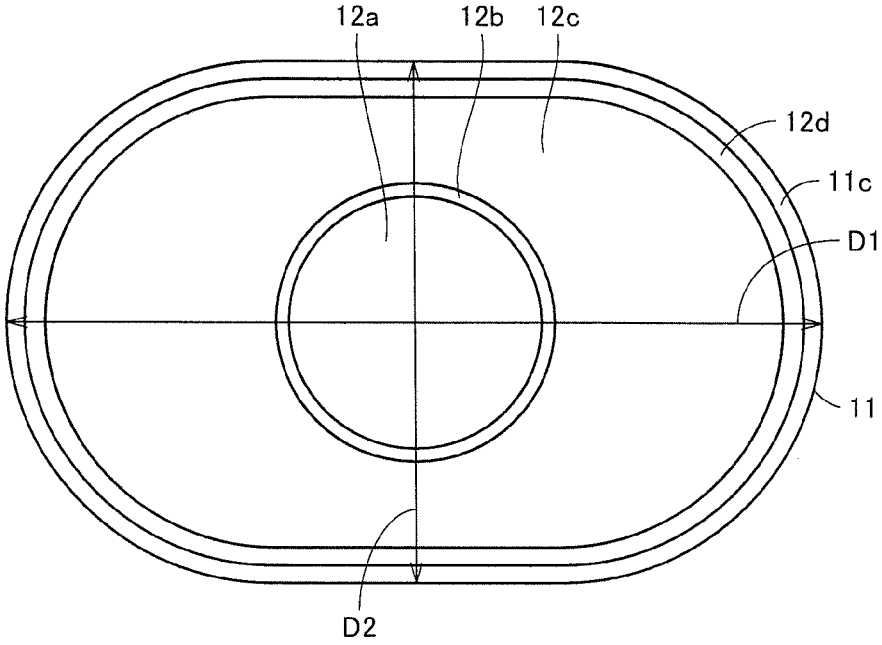
FIG. 7 is a plan view schematically showing a speaker unit of the third modification in the first embodiment of the present invention.

Referring to FIG. 7, in the third modification of the present embodiment, as seen in the direction in which frame 11 and vibration plate 12 overlap with each other, frame 11 and vibration plate 12 each are formed in a stadium shape. The stadium shape used herein refers to the shape formed by connecting both ends of each of two straight lines with circular arcs, that is, the shape having a rectangular center portion capped by semicircles at opposite sides. Vibration plate 12 has radial direction D1 in the direction of a longer dimension and a radial direction D2 in the direction of a shorter dimension.

Although an explanation has been made with regard to the case where the speaker unit is formed in a stadium shape as seen in the plan view as the third modification of the present embodiment, the speaker unit may be formed in an elliptical shape as seen in the plan view.

Then, the functions and effects of the present embodiment will be described.

The relationship between the radius of curvature of the edge portion and the lowest resonance frequency will be first described. A vibration plate can be regarded as a leaf spring, and therefore, can be described as in the following.

The lowest resonance frequency $f_0$ is calculated by the following equation (1) as a spring constant k and a vibration system mass M(g).

[Equation 1]

$$f_0 = \frac{1}{2\pi}\sqrt{\frac{k}{M}} \tag{1}$$

Spring constant k included in the equation (1) and having an influence on the shape of the vibration plate is calculated by the following equation (2) as a load P (N) and a deflection amount σ (mm).

[Equation 2]

$$k = \frac{P}{\sigma} \tag{2}$$

Deflection amount σ of the leaf spring in the shape of a circular arc in the equation (2) is calculated by the following equation (3) as a circular arc angle c (°), a circular arc radius (radius of curvature) r (mm), Young's modulus E, and a bending moment I.

[Equation 3]

$$\sigma = c \cdot \frac{Pr^3}{EI} \tag{3}$$

The equation (3) is substituted into the equation (2) to achieve the following equation (4).

[Equation 4]

$$k = \frac{1}{c \cdot r^3} \cdot EI \tag{4}$$

Assuming that EI in the equation (4) is a constant, the value of spring constant k varies in accordance with circular arc angle c (°) and circular arc radius (radius of curvature) r (mm). The lowest resonance frequency $f_0$ is calculated by substituting the equation (4) into the equation (1). According to the equations (1) and (4), when circular arc radius (radius of curvature) r is relatively large, spring constant k is reduced and the lowest resonance frequency $f_0$ is decreased, whereas when circular arc radius (radius of curvature) r is relatively small, spring constant k is increased and the lowest resonance frequency $f_0$ is increased. In other words, the greater the radius of curvature r is, the more the lowest resonance frequency $f_0$ is decreased.

Furthermore, when circular arc angle c is relatively large, spring constant k is reduced and the lowest resonance frequency $f_0$ is decreased, whereas circular arc angle c is relatively small, spring constant k is increased and the lowest resonance frequency $f_0$ is increased. In other words, even in the case where radius of curvature r is the same, the greater circular arc angle c is, the more the lowest resonance frequency $f_0$ is decreased.

As to deflection amount (amplitude amount) σ, according to the equation (3), the greater radius of curvature r is, the more amplitude amount σ obtained when a certain load P (Lorentz force) is added is increased. It is to be noted that amplitude amount σ at this time is a comparison value assuming that the Lorentz force is constant, but not the allowable amplitude amount at the time when the Lorentz force is increased (that is, the greatest amplitude amount at which a tensioned state arises).

As described above, in general, the greater radius of curvature r of the edge portion is, the more amplitude amount σ at the time when a certain force is received from the voice coil is increased, so that the lowest resonance frequency $f_0$ can be decreased.

Then, the functions and effects of the present embodiment will be described as compared with the comparative examples.

Figure 8:
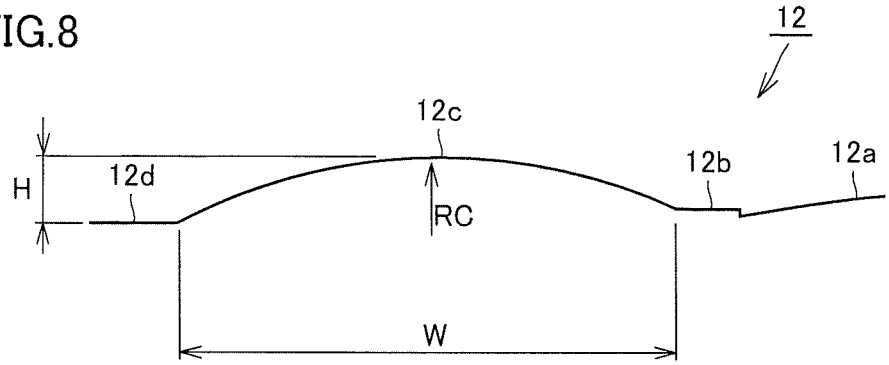
FIG. 8 is a cross sectional view schematically showing a vibration plate of the comparative example and also an enlarged view of the position corresponding to the P area in FIG. 3.

Referring to FIGS. 3 and 8, in vibration plate 12 of the comparative example, edge portion 12*c* has one radius of curvature RC. Since speaker unit 10 (FIG. 1) is required to be reduced in size, a width W of edge portion 12*c* is limited. In order to decrease the lowest resonance frequency, it is effective to increase radius of curvature RC of edge portion 12*c*. However, when radius of curvature RC of edge portion 12*c* is increased within the limitation of width W of edge portion 12*c*, the shape of vibration plate 12 in radial direction D1 (FIG. 2) becomes nearly a straight line. Accordingly, a height H of edge portion 12*c* is lowered and the line length of edge portion 12*c* in the radial direction is shortened. In the state where the line length of edge portion 12*c* in the radial direction is shortened, a tensioned state is likely to arise when vibration plate 12 vibrates up and down. This tensioned state may cause unusual noise. When unusual noise is produced, the basic sound quality of speaker unit 10 cannot be maintained. Therefore, in edge portion 12*c* configured to have one radius of curvature RC, it is difficult to decrease the resonance frequency while maintaining the basic sound quality of speaker unit 10.

In contrast, according to vibration plate 12 of the present embodiment, as seen in the cross section of vibration plate 12 in radial direction D1, center portion 120, one end 121 and the other end 122 each are formed in a circular arc such that edge portion 12*c* forms a convex so as to protrude in a direction in which the protruding shape protrudes. In addition, radius of curvature R0 of the circular arc of center portion 120 is not less than radius of curvature R1 of the circular arc of one end 121 and radius of curvature R2 of the circular arc of the other end 122.

Accordingly, the lowest resonance frequency can be decreased by increasing radius of curvature R0 of the circular arc of center portion 120. Furthermore, the line length of edge portion 12*c* in the radial direction can be increased by decreasing each of radius of curvature R1 of the circular arc of one end 121 and radius of curvature R2 of the circular arc of the other end 122. Specifically, as shown in FIG. 4, in the case where the position of each of a one end portion P1 and the other end portion P2 in one end 121 is fixed, radius of curvature R1 of the circular arc of one end 121 is decreased to thereby allow an increase in the line length of one end 121 in the radial direction. Furthermore, in the case where the position of each of one end portion P1 and the other end portion P2 in the other end 122 is fixed, radius of curvature R2 of the circular arc of the other end 122 is decreased to thereby allow an increase in the line length of the other end 122 in the radial direction. In this way, the line length of edge portion 12*c* in the radial direction can be increased. Consequently, edge portion 12*c* can be prevented from being brought into a tensioned state. Accordingly, occurrence of the unusual noise resulting from the tensioned state can be suppressed.

Furthermore, since the rising angle of each of one end 121 and the other end 122 can be increased, the strength against the vibration direction (upward and downward directions) of vibration plate 12 may be enhanced. Consequently, since the rigidity of vibration plate 12 is improved, distortion can be reduced. Therefore, high-quality sound can be realized by suppressing occurrence of distortion.

Furthermore, when vibration plate 12 excessively vibrates, one end 121 and the other end 122 each serve as a cushioning member, so that occurrence of the noise resulting from the tensioned state can be suppressed.

Furthermore, the lead of voice coil 14 extends from the vicinity of voice coil attachment portion 12*b* and passes below center portion 120 to reach frame 11 in the vicinity of frame attachment portion 12*d* at which the lead is fixed. Since the clearance (gap) between edge portion 12*c* and the lead of voice coil 14 can be increased by one end 121 and the other end 122, contact between edge portion 12*c* and voice coil 14 (contact failure resulting from vibration) can be suppressed.

Furthermore, according to vibration plate 12 of the present embodiment, since radius of curvature R0 of center portion 120 is greater than each of radius of curvature R1 of one end 121 and radius of curvature R2 of the other end 122, the line length of edge portion 12*c* in the radial direction can be increased while increasing radius of curvature R0 of the circular arc of center portion 120. Radius of curvature R0 of the circular arc of center portion 120 is increased to thereby allow height H of edge portion 12*c* to be kept low, while radius of curvature R1 of the circular arc of one end 121 and radius of curvature R2 of the circular arc of the other end 122 each are decreased to thereby allow an increase in the line length of edge portion 12*c* in the radial direction.

Furthermore, according to vibration plate 12 of the present embodiment, since radius of curvature R0 of center portion 120 is infinite, center portion 120 has a cross section shaped in a straight line, which allows the lowest resonance frequency to be further decreased.

Furthermore, according to vibration plate 12 of the present embodiment, radius of curvature R0, radius of curvature R1 and radius of curvature R2 of center portion 120, one end 121 and the other end 122, respectively, are infinite. Accordingly, in the case where height H of edge portion 12*c* is the same, the line length of edge portion 12*c* in the radial direction can be maximized. Accordingly, the tensioned state of edge portion 12*c* can be further suppressed.

Furthermore, speaker unit 10 of the present embodiment includes one of the above-described vibration plates 12, voice coil 14 attached to voice coil attachment portion 12*b*, magnet 15 disposed so as to face voice coil 14, and frame 11 supporting magnet 15 and attached to frame attachment portion 12*d*.

According to speaker unit 10 of the present embodiment, since any one of the above-described vibration plates 12 is provided, occurrence of the noise resulting from the tensioned state can be suppressed while decreasing the resonance frequency. Furthermore, radius of curvature R0 of the circular arc of center portion 120 is increased to thereby allow height H of edge portion 12*c* to be kept low, so that speaker unit 10 can be reduced in size.

Second Embodiment

The configuration of the portable information terminal in the present embodiment will be first described. The portable information terminal provided with the speaker unit of the first embodiment will be described in the present embodiment.

Figure 9:
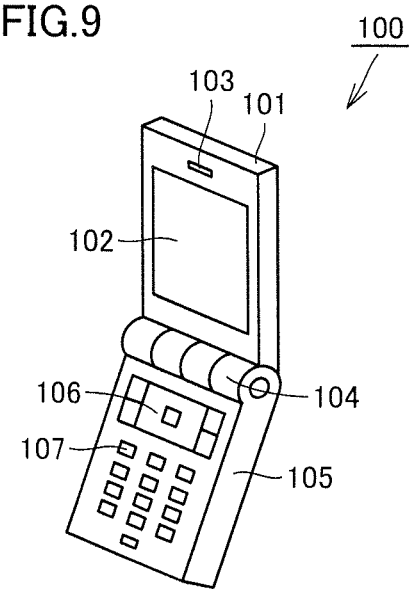
FIG. 9 is a perspective view schematically showing a portable information terminal in the second embodiment of the present invention.
Figure 10:
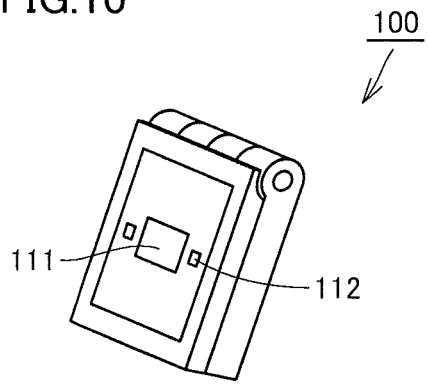
FIG. 10 is a perspective view schematically showing the state where the portable information terminal in the second embodiment of the present invention is folded.

Referring to FIGS. 9 and 10, a portable information terminal 100 in the present embodiment which serves as a mobile phone mainly includes an upper housing 101, a display unit 102, a sound emitting hole 103, a hinge portion 104, a lower housing 105, an operation button 106, number buttons 107, a display unit 111, a sound emitting hole 112, and a speaker unit according to the first embodiment which is not shown.

Referring to FIG. 9, display unit 102 is provided on the surface of upper housing 101. Sound emitting hole 103 is formed on the surface of upper housing 101 closer to the one end thereof. Hinge portion 104 is provided closer to the other end of upper housing 101. Hinge portion 104 is provided closer to the one end of lower housing 105. Upper housing 101 and lower housing 105 are connected by hinge portion 104 such that these housings can be opened and closed. Operation button 106 is provided on the surface of lower housing 105 closer to hinge portion 104. Number buttons 107 are provided across operation button 106 from hinge portion 104.

Referring to FIG. 10, display unit 111 is provided on the backside surface of upper housing 101. Sound emitting hole 112 is provided adjacent to display unit 111.

The speaker unit described in the first embodiment which is not shown is provided within upper housing 101. The speaker unit emits sound mainly through sound emitting holes 103 and 112 to the outside of portable information terminal 100.

Then, the functions and effects of the portable information terminal according to the present embodiment will be described.

According to portable information terminal 100 in the present embodiment, since the speaker unit described in the above-described first embodiment is provided, the functions and effects identical to those in the first embodiment can be achieved.

Furthermore, since the speaker unit described in the above-described first embodiment is provided, portable information terminal 100 can be reduced in size by reducing the size of speaker unit 10. The design flexibility can also be improved.

Although the portable information terminal has been described by taking a mobile phone as an example in the present embodiment, the portable information terminal is not limited thereto, but may be a digital camera, a personal computer, a game machine, a PDA, and the like.

EXAMPLES

Examples of the present invention will be hereinafter described. It is to be noted that the same or corresponding components are designated by the same reference characters, and description thereof may not be repeated.

Example 1

Figure 11:
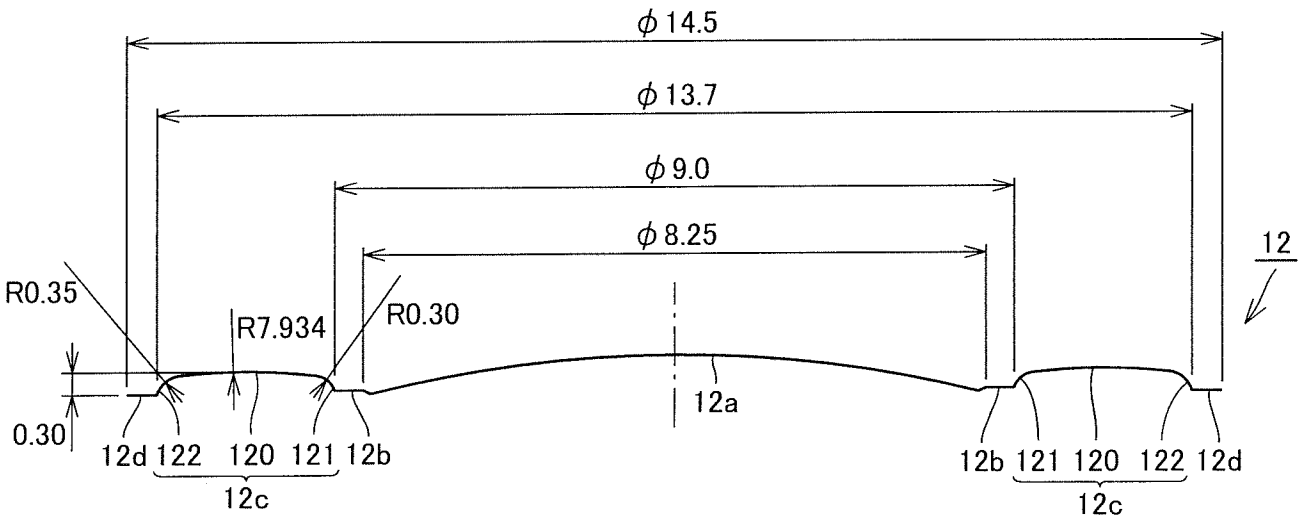
FIG. 11 is a cross sectional view schematically showing a vibration plate of Example A in the first embodiment of the present invention.

Vibration plate 12 having sizes shown in FIG. 11 was fabricated as Example A. Referring to FIG. 11, vibration plate 12 has an outer diameter of 14.5 mm. Center vibration portion 12*a* has a diameter of 8.25 mm. Voice coil attachment portion 12*b* has a diameter of 9.0 mm. Edge portion 12*c* has a diameter of 13.7 mm. Frame attachment portion 12*d* has a diameter of 14.5 mm. Frame attachment portion 12*d* has a diameter that is equal to the diameter of vibration plate 12. In edge portion 12*c*, center portion 120 has a radius of curvature R 7.934 mm, one end 121 has a radius of curvature R0.30 mm, and the other end 122 has a radius of curvature R 0.35 mm. Edge portion 12*c* has a height of 0.30 mm.

Figure 12:
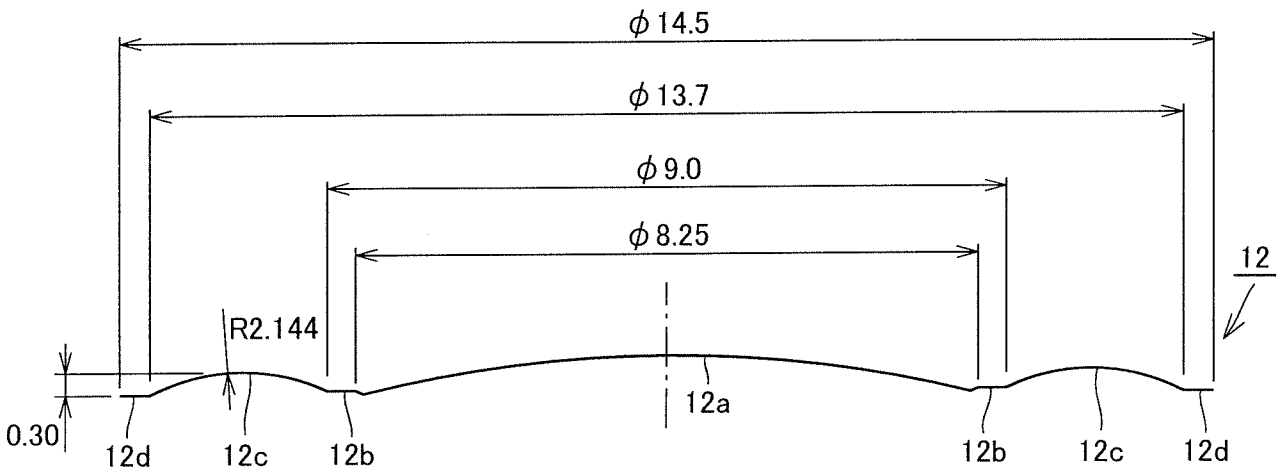
FIG. 12 is a cross sectional view schematically showing a vibration plate of Comparative Example A in the first embodiment of the present invention.

Vibration plate 12 having sizes shown in FIG. 12 was fabricated as Comparative Example A. Referring to FIG. 12, the outer diameter of vibration plate 12, the diameter of center vibration portion 12*a*, the diameter of voice coil attachment portion 12*b*, the diameter of edge portion 12*c*, the diameter of frame attachment portion 12*d*, and the height of edge portion 12*c* are identical to those in Example A. Edge portion 12*c* has a radius of curvature R2.144 mm.

In each of Example A and Comparative Example A, the lowest resonance frequency $f_0$ was measured under the same test conditions. The test results are shown in Table 1. Referring to Table 1, the lowest resonance frequency $f_0$ in Comparative Example A was 1000 Hz whereas the lowest resonance frequency $f_0$ in Example A was 800 Hz.

TABLE 1

| | Lowest Resonance Frequency $f_0$ (Hz) |
|---|---|
| Comparative Example A | 1000 |
| Example A | 800 |

When comparing Example A with Comparative Example A, in Example A, edge portion 12*c* is configured such that center portion 120, one end 121 and the other end 122 each have a radius of curvature, that is, there are three radii of curvature, from which Comparative Example A is different in that there is only one radius of curvature. It has been found from this difference that the lowest resonance frequency $f_0$ is lower in Example A than in Comparative Example A. In other words, it has been found that the lowest resonance frequency $f_0$ is lower in Example A in which edge portion 12*c* has three radii of curvature than in Comparative Example A in which there is only one radius of curvature.

Example 2

As to the vibration plate having an edge portion formed in various shapes, the lowest resonance frequency was analyzed by using a finite element method. The lowest resonance frequency was analyzed, by stress analysis software, using the sizes shown in each of FIGS. 13 to 19 corresponding to Comparative Examples B and C and Examples B to F, respectively, which will be described below.

First, with regard to the vibration plate having one radius of curvature, an analysis was conducted about the relationship between the edge portion width and the lowest resonance frequency in the case where the radius of curvature of the edge portion is the same.

Figure 13:
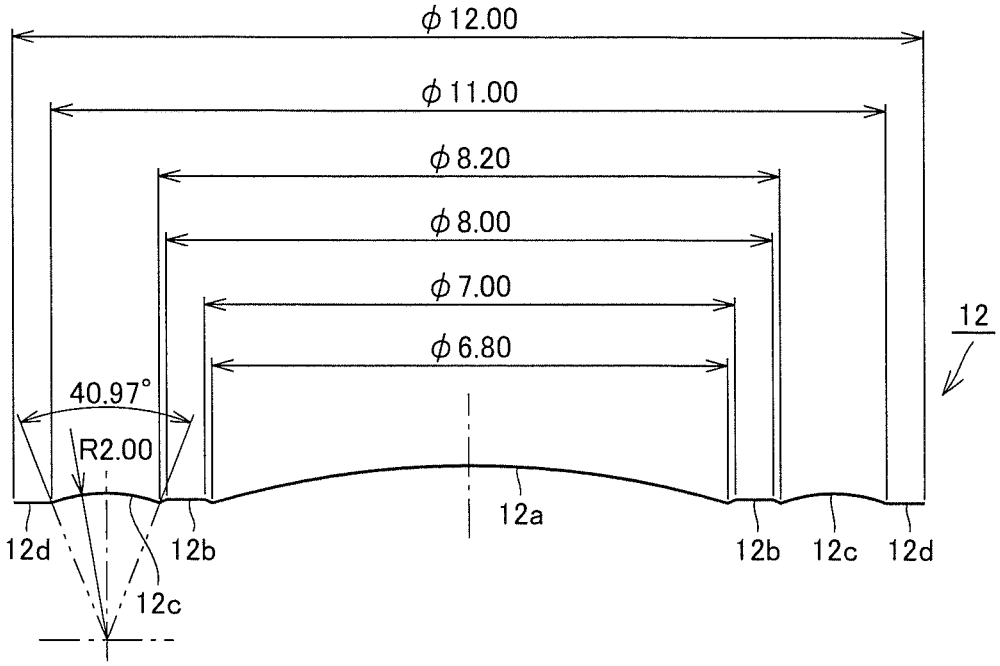
FIG. 13 is a cross sectional view schematically showing a vibration plate of Comparative Example B in the second embodiment of the present invention.

Comparative Example B includes sizes shown in FIG. 13. Referring to FIG. 13, vibration plate 12 has an outer diameter of 12.0 mm. Center vibration portion 12*a* has a diameter of 6.80 mm. Voice coil attachment portion 12*b* has a diameter of 8.20 mm. Voice coil attachment portion 12*b* has both ends which are tapered. Edge portion 12*c* has a diameter of 11.0 mm. Frame attachment portion 12*d* has a diameter of 12.00 mm. Frame attachment portion 12*d* has a diameter that is equal to the diameter of vibration plate 12. Edge portion 12*c* has a radius of curvature R2.00 mm. Edge portion 12*c* has a circular arc angle of 40.97°.

Figure 14:
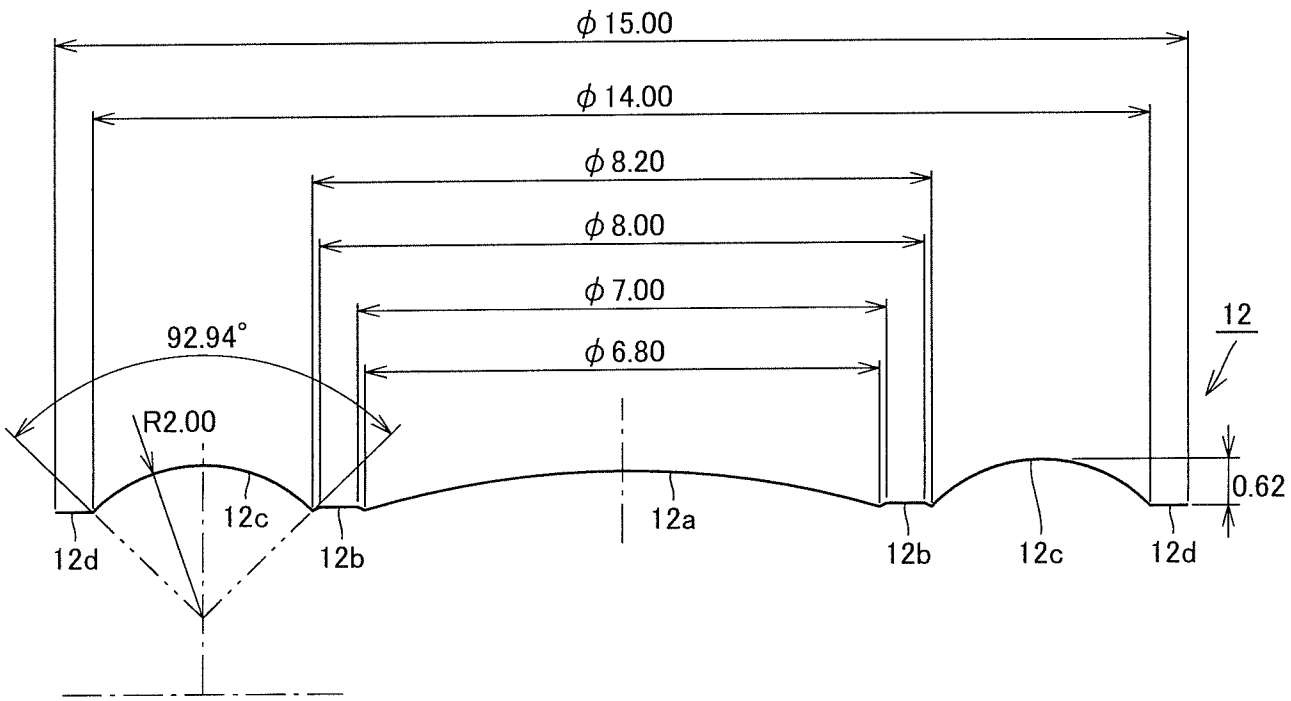
FIG. 14 is a cross sectional view schematically showing a vibration plate of Comparative Example C in the second embodiment of the present invention.

Comparative Example C includes sizes shown in FIG. 14. Referring to FIG. 14, vibration plate 12 has an outer diameter of 15.0 mm. Center vibration portion 12*a* has a diameter of 6.80 mm. Voice coil attachment portion 12*b* has a diameter of 8.20 mm. Voice coil attachment portion 12*b* has both ends which are tapered. Edge portion 12*c* has a diameter of 14.0 mm. Frame attachment portion 12*d* has a diameter of 15.00 mm. Frame attachment portion 12*d* has a diameter that is equal to the diameter of vibration plate 12. Edge portion 12*c* has a radius of curvature R2.00 mm. Edge portion 12*c* has a circular arc angle of 92.94°.

As compared with Comparative Example B, in Comparative Example C, edge portion 12*c* is set to have a diameter increased by 3.0 mm. In other words, in Comparative Example C, edge portion 12*c* is set to have a width increased by 1.5 mm as compared with Comparative Example B.

Table 2 shows the main sizes and the analysis results of the lowest resonance frequency $f_0$ in each of Comparative Examples B and C. Referring to Table 2, the lowest resonance frequency $f_0$ in Comparative Example B was 573 Hz whereas the lowest resonance frequency $f_0$ in Comparative Example C was 550 Hz.

TABLE 2

| | Outer Diameter of Vibration Plate (mm) | Width of Edge Portion (mm) | Radius of Curvature of Edge Portion (mm) | Circular Arc Angle (°) | Lowest Resonance Frequency $f_0$ (Hz) |
|---|---|---|---|---|---|
| Comparative Example B | 12.00 | 1.40 | 2.00 | 40.97 | 573 |
| Comparative Example C | 15.00 | 2.90 | 2.00 | 92.94 | 550 |

When comparing Comparative Example B with Comparative Example C, the edge portion in each Comparative Example has the same radius of curvature R2.00 mm, whereas the width of the edge portion is set at 2.9 mm in Comparative Example C which is greater than 1.4 mm in Comparative Example B. Accordingly, the circular arc angle is set at 92.94° in Comparative Example C which is greater than 40.97° in Comparative Example B. Consequently, it has been found that, in the case where the edge portions have the same radius of curvature, the greater the width of the edge portion is, the more the lowest resonance frequency $f_0$ is decreased. It has also been found that the circular arc angle exerts an influence upon the lowest resonance frequency $f_0$.

Then, an analysis was conducted for the lowest resonance frequency in the case where the same outer diameter of the vibration plate, the same width of the edge portion and the same height of the edge portion were applied in each Example, but the radius of curvature of the center portion in the edge portion and the radius of curvature of each end (one end and the other end) in the edge portion each were differently set. In addition, one end and the other end were set to have the same radius of curvature in each Example. The analysis results are shown in Table 3.

TABLE 3

| | Outer Diameter of Vibration Plate (mm) | Radius of Curvature of Each End in Edge Portion (mm) | Radius of Curvature of Center Portion in Edge Portion (mm) | Lowest Resonance Frequency $f_0$ (Hz) | Line Length of Edge Portion (mm) |
|---|---|---|---|---|---|
| Comparative Example C | 15.00 | — | 2.00 | 550 | 3.24 |
| Example B | 15.00 | 0.30 | 2.51 | 477 | 3.37 |
| Example C | 15.00 | 0.40 | 2.99 | 427 | 3.42 |
| Example D | 15.00 | 0.50 | 4.24 | 348 | 3.50 |
| Example E | 15.00 | 0.62 | ∞ | 238 | 3.61 |
| Example F | 15.00 | ∞ | ∞ | 157 | 4.14 |

In each of Examples B to F, as shown in FIGS. 15 to 19, respectively, the outer diameter of vibration plate 12, the diameter of center vibration portion 12*a*, the diameter of voice coil attachment portion 12*b*, the diameter of edge portion 12*c*, and the diameter of frame attachment portion 12*d* are set equal to those in Comparative Example C. Edge portion 12*c* is set to have a height of 0.62 mm. In each of Examples B to F, edge portion 12*c* has three radii of curvature.

Figure 15:
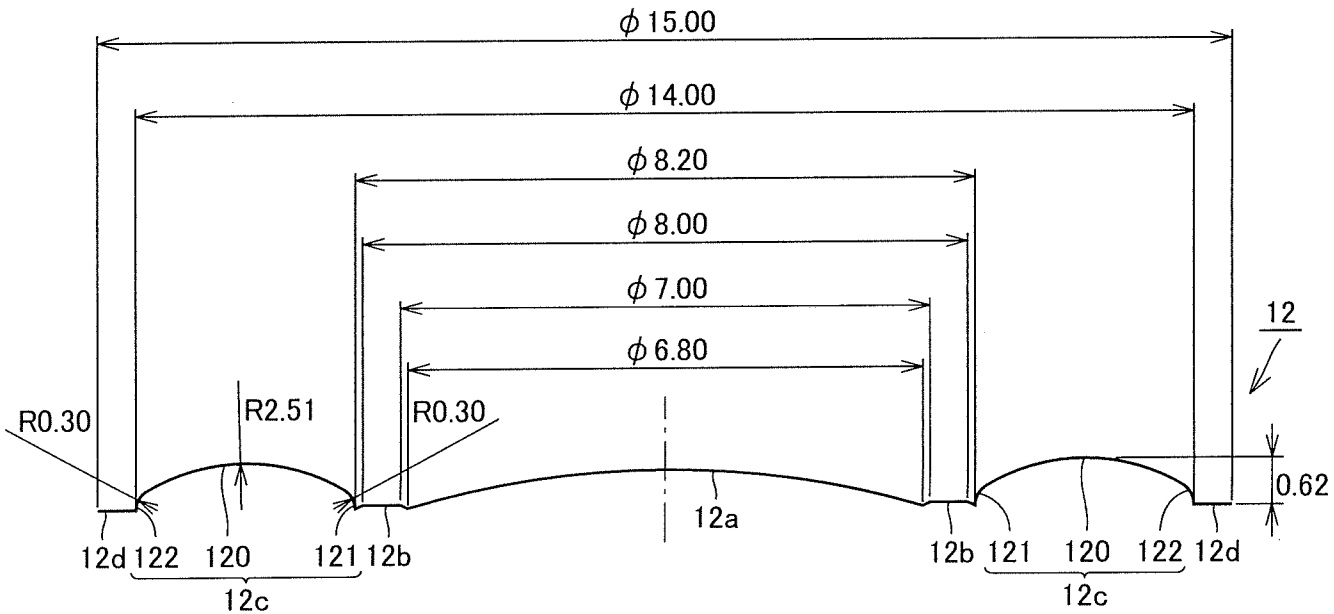
FIG. 15 is a cross sectional view schematically showing a vibration plate of Example B in the second embodiment of the present invention.
Figure 16:
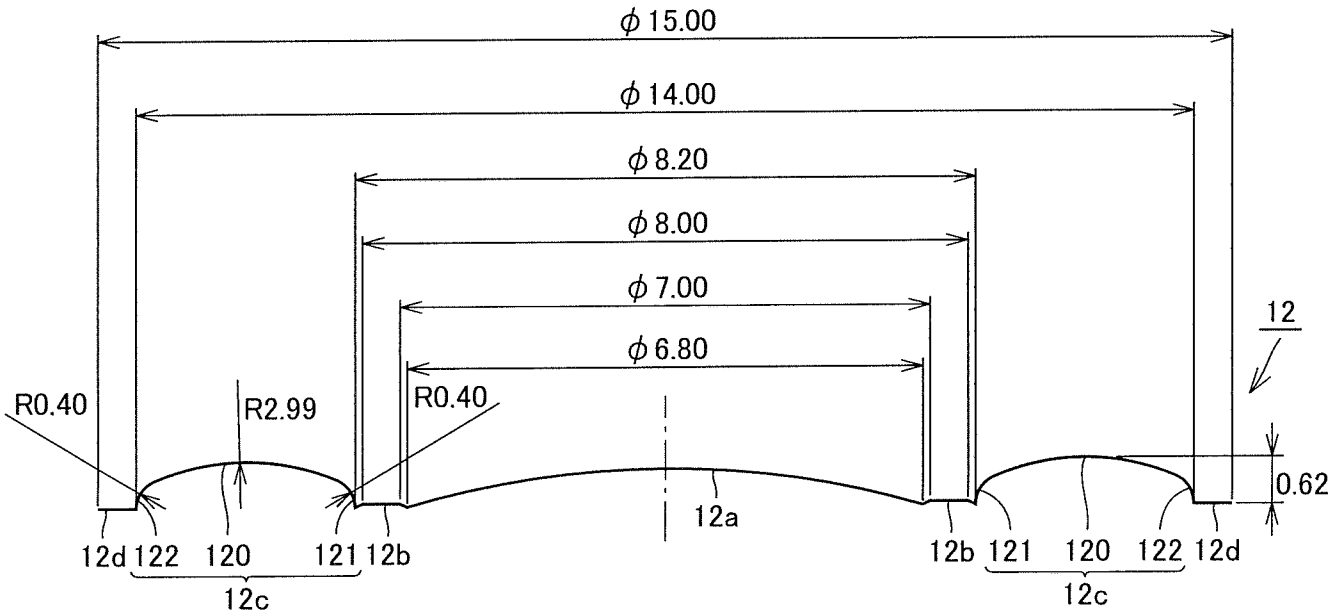
FIG. 16 is a cross sectional view schematically showing a vibration plate of Example C in the second embodiment of the present invention.
Figure 17:
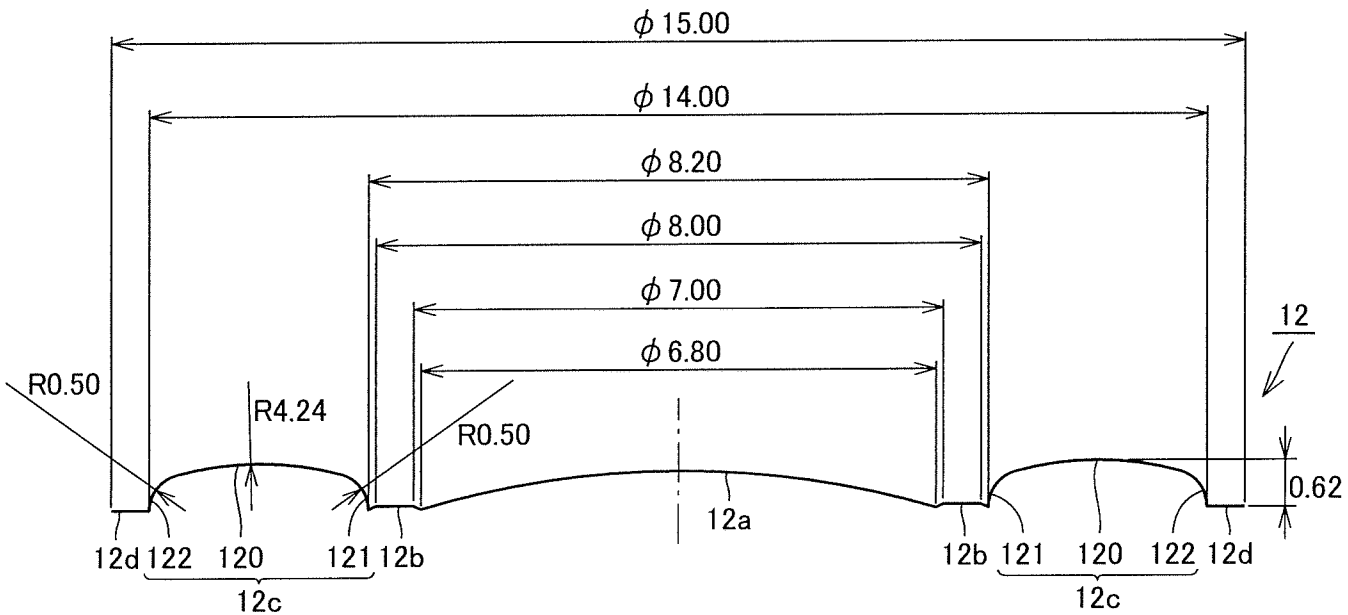
FIG. 17 is a cross sectional view schematically showing a vibration plate of Example D in the second embodiment of the present invention.
Figure 18:
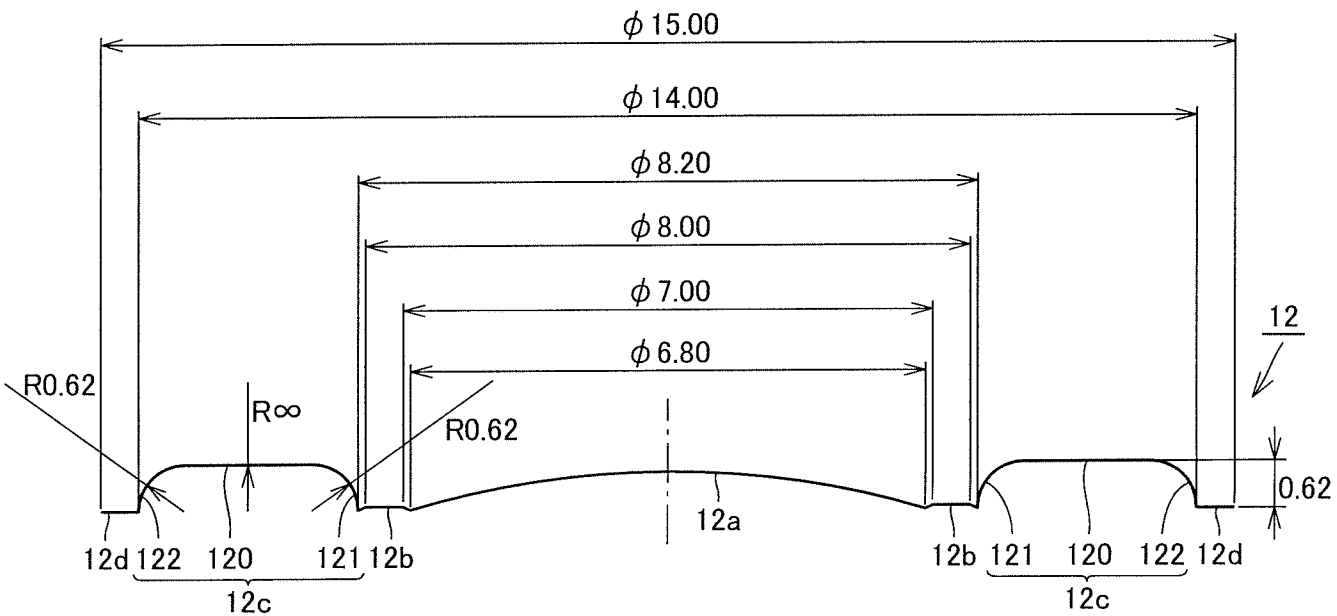
FIG. 18 is a cross sectional view schematically showing a vibration plate of Example E in the second embodiment of the present invention.
Figure 19:
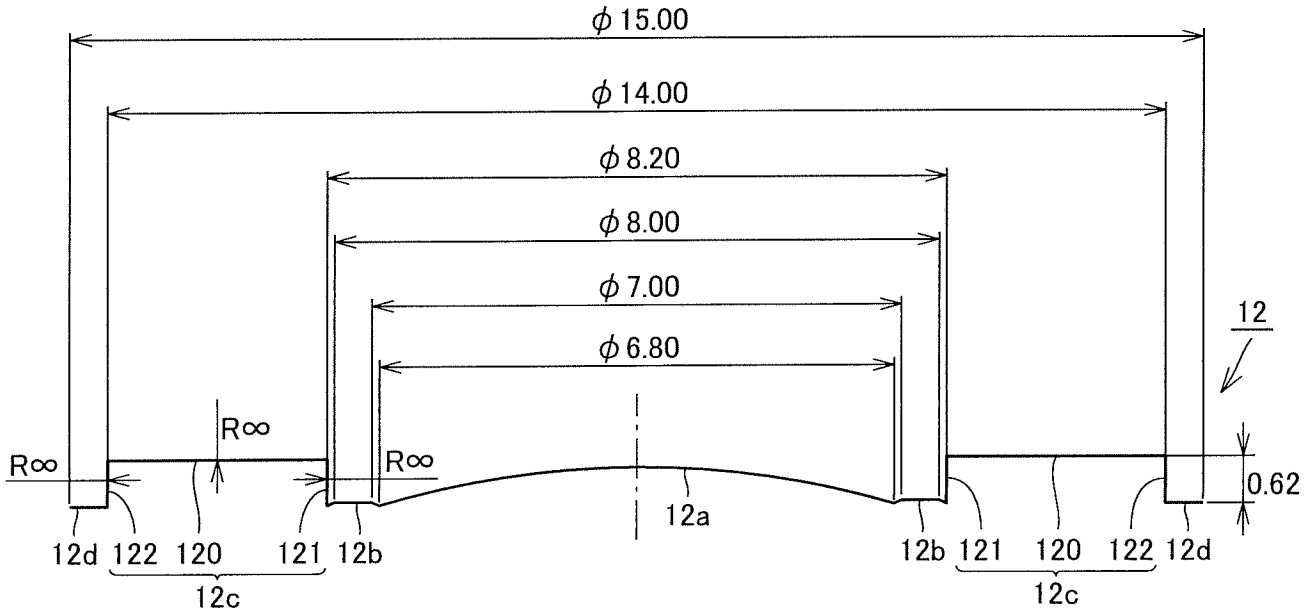
FIG. 19 is a cross sectional view schematically showing a vibration plate of Example F in the second embodiment of the present invention.

Example B includes sizes shown in FIG. 15. Referring to FIG. 15, in Example B, the center portion in the edge portion has a radius of curvature R2.51 mm while the end in the edge portion has a radius of curvature R0.30 mm. Example C includes sizes shown in FIG. 16. Referring to FIG. 16, in Example C, the center portion in the edge portion has a radius of curvature R2.99 mm while the end in the edge portion has a radius of curvature R0.40 mm. Example D includes sizes shown in FIG. 17. Referring to FIG. 17, in Example D, the center portion in the edge portion has a radius of curvature R4.24 mm while the end in the edge portion has a radius of curvature R0.50 mm. Example E includes sizes shown in FIG. 18. Referring to FIG. 18, in Example E, the center portion in the edge portion has a radius of curvature R∞ (infinite) mm while the end in the edge portion has a radius of curvature R0.62 mm. Example F includes sizes shown in FIG. 19. Referring to FIG. 19, in Example F, the center portion in the edge portion has a radius of curvature R∞ (infinite) mm while the end in the edge portion has a radius of curvature R∞ (infinite) mm.

Referring to Table 3, it has been found that the lowest resonance frequency $f_0$ is lower in each of Examples B to F than in Comparative Example C. In other words, it has been found that the lowest resonance frequency $f_0$ is lower in each of Examples B to F in which edge portion 12*c* has three radii of curvature than in Comparative Example C in which there is only one radius of curvature.

Furthermore, it has been found that, in each of Examples B to F, the greater the radius of curvature of the center portion in the edge portion is, the more the lowest resonance frequency $f_0$ is decreased. Furthermore, it has been found that, in each of Examples B to F, the greater the radius of curvature of the end in the edge portion is, the more the lowest resonance frequency $f_0$ is decreased.

Furthermore, it has also been found from Example E that the lowest resonance frequency $f_0$ is further decreased in the case where the center portion in the edge portion has a radius of curvature R∞. Furthermore, it has also been found from Example F that the lowest resonance frequency $f_0$ becomes lowest in the case where the center portion in the edge portion has a radius of curvature R∞ and the end in the edge portion has a radius of curvature R∞

It has also been found that the line length of the edge portion is longer in each of Examples B to F than in Comparative Example C. It has been found from Example F that the line length of the edge portion becomes longest in the case where the center portion in the edge portion has a radius of curvature R∞ while the end in the edge portion has a radius of curvature R∞.

It is to be noted that the above-described embodiments can be combined as appropriate.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A vibration plate having a voice coil attachment portion, a frame attachment portion and an edge portion which is located between said voice coil attachment portion and said frame attachment portion and has a protruding shape protruding in one direction with respect to said voice coil attachment portion and said frame attachment portion, said edge portion comprising:

a center portion;

one end located between said center portion and said voice coil attachment portion; and an other end located between said center portion and said frame attachment portion, as seen in a cross section of said vibration plate in a radial direction, said center portion, said one end and said other end each being formed in a circular arc such that said edge portion forms a convex so as to protrude in a direction in which said protruding shape protrudes, and a radius of curvature of the circular arc of said center portion being not less than the radius of curvature of the circular arc of each of said one end and said other end.

2. The vibration plate according to claim 1, wherein the radius of curvature of said center portion is greater than the radius of curvature of each of said one end and said other end.

3. The vibration plate according to claim 1, wherein the radius of curvature of said center portion is infinite.

4. The vibration plate according to claim 1, wherein the radius of curvature of each of said center portion, said one end and said other end is infinite.

5. A speaker unit comprising:

the vibration plate according to claim 1;

a voice coil attached to said voice coil attachment portion;

a magnet disposed so as to face said voice coil; and a frame supporting said magnet and attached to said frame attachment portion.

6. A portable information terminal comprising the speaker unit according to claim 5.

* * * * *